United States Patent [19]

Engele

[11] 4,200,064

[45] Apr. 29, 1980

[54] ELECTRONIC APPARATUS FOR FEED CONTROL OF AIR-GASOLINE MIXTURE IN INTERNAL COMBUSTION ENGINES

[75] Inventor: Horst Engele, Tedesca, Italy

[73] Assignee: Fabbrica Italiana Magneti Marelli S.p.A., Milan, Italy

[21] Appl. No.: 898,545

[22] Filed: Apr. 21, 1978

[30] Foreign Application Priority Data

Apr. 27, 1977 [IT] Italy ..... 22843 A/77

[51] Int. Cl.[2] ..... F02B 3/00

[52] U.S. Cl. ..... 123/32 EB; 123/32 EE; 123/119 EC

[58] Field of Search ..... 123/32 EB, 32 EE, 117 D, 123/119 EC

[56] References Cited

U.S. PATENT DOCUMENTS

| | | | |
|---|---|---|---|
| 3,689,755 | 9/1972 | Hodgson | 123/32 EB |
| 3,906,207 | 9/1975 | Rivere | 123/32 EB |
| 3,942,493 | 3/1976 | Linder | 123/119 EC |
| 4,130,095 | 12/1978 | Bowler et al. | 123/32 EB |

*Primary Examiner*—Ronald B. Cox

*Attorney, Agent, or Firm*—Ostrolenk, Faber, Gerb & Soffen

[57] ABSTRACT

An apparatus for controlling the air-gasoline mixture supplied to an internal combustion engine is disclosed. A microcomputer receives a plurality of input signals representative of characteristic magnitudes of engine operation and of the air-gasoline ratio and controls the operation of a metering device as a function of the signals. The microcomputer is programmed with a predetermined feed law to provide predetermined engine performances. The feed law is stored in the form of numerical values, each of which correspond to the metering amount of the metering device which amount has been predetermined to result in the optimum strength of the air-gasoline mixture. The microcomputer is adapted to correct the numerical values in accordance with the difference between the programmed numerical value corresponding to the stoichiometrical air-gasoline ratio and that value which makes it possible to effectively obtain the stoichiometrical ratio under the actual engine operating conditions.

13 Claims, 6 Drawing Figures

| rev/min | 20 | 80 | 140 | 200 | 260 | 320 | 380 |
|---|---|---|---|---|---|---|---|
| 4.000 | 16 | 17 | 17 | 14 | 15 | 16 | 17 |
| 3.500 | 16 | 16 | 15 | 12 | 14 | 15 | 16 |
| 3.000 | 15 | 15 | 14 | 13 | 12 | 14 | 15 |
| 2.500 | 15 | 14 | 13 | 12 | 13 | 13 | 14 |
| 2.000 | 14 | 12 | 11 | 10 | 11 | 12 | 15 |
| 1.500 | 14 | 13 | 11 | 10 | 12 | 11 | 14 |
| 1.000 | 13 | 13 | 12 | 11 | 10 | 11 | 13 |
mm. Hg.
FIG. 3
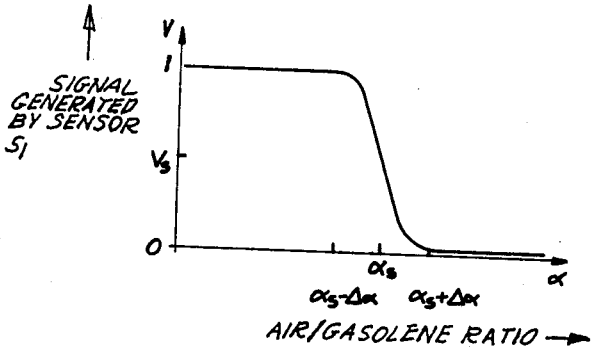
FIG. 4
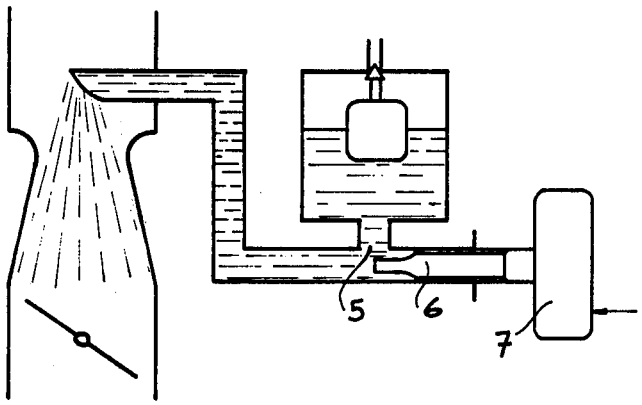
FIG. 5

ELECTRONIC APPARATUS FOR FEED CONTROL OF AIR-GASOLINE MIXTURE IN INTERNAL COMBUSTION ENGINES

BACKGROUND OF THE INVENTION

This invention relates to an electronic apparatus for controlling the air-gasoline mixture supplied to an internal combustion engine.

Devices are known for feeding internal combustion engines with an air-gasoline mixture. Such devices normally comprise a sensor for sensing the exhaust gases and for providing signals corresponding to the strength of the air-gasoline mixture at a rate of about the stoichiometrical ratio; a plurality of sensors of characteristic magnitudes for sensing the engine operation and external environment and for providing signals corresponding to these magnitudes; a governor device for the strength of the engine feed air-gasoline mixture; and an electronic device having applied thereto both the signals supplied by the exhaust gas sensor and the signals supplied by the sensors of the engine and external environment characteristic magnitudes, the electronic device controlling the air-gasoline mixture governor device as a function of such signals, so as to obtain predetermined operating conditions of the engine.

A drawback of the prior art devices are that they are capable of detecting the air-gasoline mixture strength, by way of the exhaust gas sensors, only within a narrow range about the stoichiometrical air-gasoline ratio.

This limitation is a result of the fact that the chemical-physical conditions required to enable the sensors to detect univocally the values of the air-gasoline ratio only occur with mixtures having such ratios.

Thus, the prior art devices can control the feed of internal combustion engines only with mixtures having an air-gasoline ratio equal or close to the stoichiometrical value. As a result, these prior art devices are unfit for feed control where it is required to feed the engine with mixtures having an optimum air-gasoline ratio different from the stoichiometrical ratio to provide determined performances. For instance, it may be necessary to feed an engine with leaner or richer mixtures in order to obtain maximum power, minimum consumption, low pollution or, finally, compromises of these and further performances.

BRIEF DESCRIPTION OF THE INVENTION

It is the object of the present invention to provide an electronic apparatus for feed control of air-gasoline mixture in internal combustion engines which makes it possible to feed such engines with mixtures having optimum values for the air-gasoline ratio either within or without the range about the stoichiometrical value, even when using a standard gas sensor, and with an accuracy and time constancy comparable to those which can be obtained by the prior art devices only within the range of the stoichiometrical ratio.

According to the invention, this is achieved by an apparatus of the above disclosed type, wherein the electronic device comprises a microcomputer, which is programmed in accordance with a desired feed law to provide predetermined performances of the engine, which law is stored in the form of numerical values, each of which corresponding to the metering amount of the governor device for the air-gasoline mixture strength, said microcomputer providing for correcting the numerical values depending on the periodically detected difference (determined during a calibrating operation) between a programmed numerical value corresponding to the stoichiometrical air-gasoline ratio and that effectively enabling to obtain said stoichiometrical ratio under the same operation conditions of the engine.

BRIEF DESCRIPTION OF THE DRAWINGS

By mere way of example, the invention will now be described with reference to the accompanying drawings, in which:

FIG. 3 is an exemplary table showing the numerical values corresponding to a desired feed law of the engine, but where air-gasoline ratios other than the stoichiometrical ratio can correspond thereto;

FIG. 4 shows the characteristic operation diagram for an exhaust gas sensor;

FIG. 5 schematically shows a second embodiment of the governor device for the mixture strength.

DETAILED DESCRIPTION OF THE INVENTION

Figure 1:
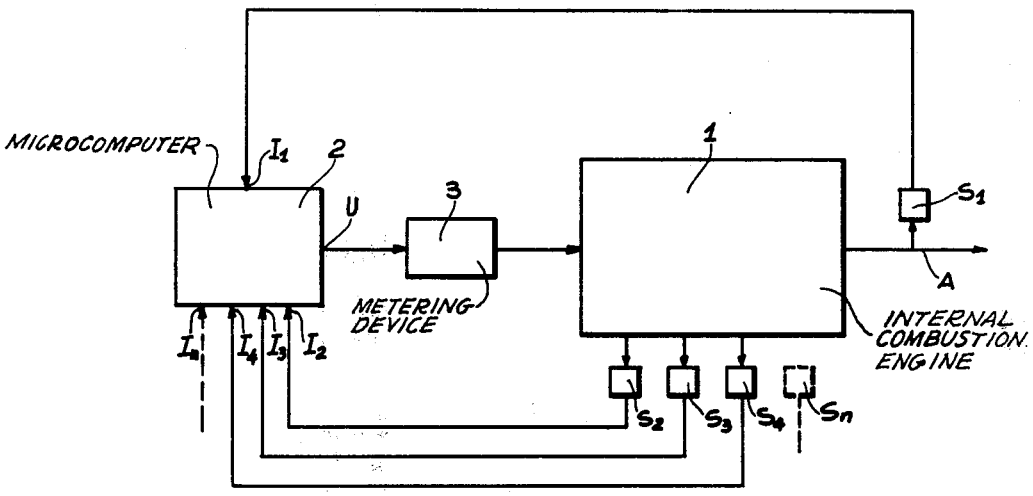
FIG. 1 is a block diagram of a feed control apparatus for an internal combustion engine comprising a microcomputer embodying the control according to the invention.

Referring now to FIG. 1 of the drawings, reference numeral 1 denotes an internal combustion engine and reference numeral 2 an electronic microcomputer.

Microcomputer input $I_1$ is connected to at least one exhaust gas sensor $S_1$ located in the engine exhaust pipe A. Such a sensor can supply signals, the values of which correspond to univocal values of the air-gasoline ratio, only with mixtures having air-gasoline ratio coincident with or close to stoichiometrical value $\alpha s$.

Microcomputer inputs $I_2, I_3, \ldots I_n$ are connected to a plurality of sensors $S_2, S_3, \ldots S_n$ sensing characteristics magnitudes of the engine operation and external environment. Such sensors can supply signals corresponding to said magnitudes. The characteristic engine magnitudes may be: vacuum in the induction manifold, engine r.p.m., engine water temperature, angle of aperture of the throttle valve, etc. The characteristic magnitudes of the external environment may be: atmospheric pressure and external temperature.

Microcomputer output U is connected to a governing or metering device 3 of the engine feed air-gasoline mixture. Such a device can govern or adjust the air-gasoline mixture by metering the amount of gasoline or the amount of inlet air, or both.

The microcomputer 2 is programmed according to a predetermined feed law, which is a function of characteristic parameters of the engine, making it possible to adjust the mixture strength for any value of air-gasoline mixture even if the value is significantly different than the stoichiometrical value. The microcomputer 2 periodically supplies suitable controls to metering device 3 so as to assure, for every operating condition that the mixture feed to the engine has a strength which is determined by the feed law and which may be within or without the stoichiometrical range. This feed law is stored, for example, in a read only memory (ROM), in the form of numerical values, each of which make it possible to obtain a predetermined strength for the air-gasoline mixture. Each value is stored within a memory cell, the address of which comprises values related to the characteristic parameters of the engine.

Calibration of adjusting device 3 is carried out by detecting the difference between a stored value that should make it possible to feed the engine with a mixture having stoichiometrical air-gasoline ratio, and the value effectively providing such a stoichiometrical ratio, and in accordance with the detected difference correcting the values as programmed by the established feed law.

The differential value used for correction may be stored in a direct access memory (RAM) which should be capable of storing this difference even when the engine is shut down. For example, this is provided by supplying such the memory with a rechargeable buffer type of battery.

The use of sensors of characteristic magnitudes of the ambient conditions makes it possible to correct the stored values of stored feed law. Conveniently according to the invention, such sensors may be removed, provided that the calibrating operation for the adjusting device is carried out at short time intervals, for instance every 10 or 15 minutes. Thus, in such a case also the change in ambient conditions is corrected with the calibrating operation.

The calibration of the governing or metering device 3 should not occur under critical conditions of engine operation such as, for example, cold, acceleration or deceleration operation. To this end, the microcomputer is preset to initiate the calibrating operation only if the engine operation conditions are those suited for such an operation, and as well is capable of shutting off the calibrating operation should such conditions change as the engine is running.

Where the mixture is adjusted by metering the amount of gasoline, the metering device 3 may be either an injector 4 (FIG. 2), wherein the gasoline flow is adjusted by varying the opening time of the injector, or a carburettor (FIG. 5), wherein the gasoline flow is adjusted by varying the cross-section of feed duct 5 by means of a screw 6 positioned by a stepping motor 7.

When using an injector, the microcomputer supplies a signal whose duration corresponds to the opening time of the injector, while when using a carburettor, the microcomputer supplies suitably out-of-phase pulse control signals to the stepping motor.

Figure 2:
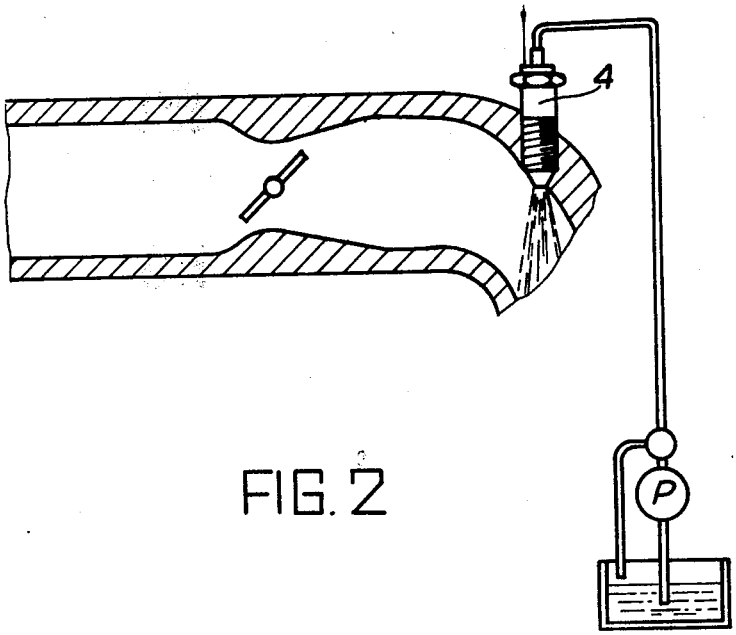
FIG. 2 schematically shows a first embodiment of the governor device for the air-gasoline mixture strength.

By way of example, assume that the metering device 3 is injector 4 of FIG. 2 and the feed law depends on two parameters such as r.p.m. and vacuum in induction manifold, as shown in FIG. 3. In such a case, the stored numerical values (fully arbitrarily shown in the table of FIG. 3) are the injection times. Such times are experimentally provided by detecting for the different operation ratings the different values of air-gasoline ratio enabling the engine to supply the desired performances.

Once the values of the table of FIG. 3 have been stored, the operation of the device is as follows:

The microcomputer detects the r.p.m. and vacuum in the induction manifold, for instance 3,000 r.p.m. and 20 mmHg and, by using these values as the memory address, reads the value of 15 msec, controlling injector 4 for such a time. If the injector is properly calibrated, the engine will be supplied with the desired air-gasoline mixture. If the injector be out of calibration, the air-gasoline mixture will be different. In order to check the situation, the calibrating operation is carried out. Assume that the injector is out of calibration, for example injecting less amounts of gasoline than desired, and the injector calibration is automatically or manually controlled. In the following example, it is assumed for simplicity that for a stoichiometrical air-gasoline ratio $\alpha s = 14.7$, the signal supplied by sensor $S_1$ (FIG. 4) is 0.5 volt, while for stoichiometrical air-gasoline ratios $\alpha s + \Delta\alpha$ and $\alpha s - \Delta\alpha$ is the signal supplied by sensor $S_1$ 0 volt and 1 volt, respectively, where $2\Delta\alpha \leq 0.8$ is the value range about the stoichiometrical value for which sensor $S_1$ supplies signals corresponding to univocal values of air-gasoline ratio. It will also be assumed that at 3000 r.p.m. and 20 mmHg vacuum, the injection time required for providing a mixture having stoichiometrical air-gasoline ratio ($\alpha s = 14.7$) is $t_s = 12$ msec and that such a value is stored in the microcomputer.

Upon calibration control, the microcomputer detects the actual value of the signal supplied by exhaust gas sensor $S_1$, (FIG. 1) for example 0.2 volts compares this value with 0.5 volt which is characteristic for the stoichiometrical air-gasoline ratio, and controls the injector for greater injection times until the signal supplied by sensor $S_1$ or its mean value reaches the value of 0.5 volt.

For example, such a condition is provided with an injection time of 13 msec.

Therefore, to feed the engine with a mixture having stoichiometrical air-gasoline ratio it was necessary to increase the injection time $t_s$ by 1 msec, or bring it from 12 msec to 13 msec.

The microcomputer stores this difference of 1 msec and, after detecting the r.p.m. and vacuum in the injection manifold, which for simplicity are still assumed to be 3000 r.p.m. and 20 mmHg, reads the value of 15 msec, corrects the same by increasing it of 1 msec, and then controls the injector for a time of 16 msec, thereby feeding the engine with a mixture having a strength corresponding to the desired feed law.

When desiring a more rapid research of the injection time enabling to feed the engine with a mixture of stoichiometrical air-gasoline ratio, upon the arrival of the calibrating control said microcomputer would control the injector for an injection time $t_s = 12$ msec, whereupon calibration will proceed as previously described.

In the example above described, a feed law was referred to, in which the stored numerical values are the absolute values of the injection times, but it is apparent that such stored numerical values could be the relative values with respect to the injection time enabling to provide a mixture having stoichiometrical air-gasoline ratio.

Referring to the above example, in the memory cell having the address of 3000 r.p.m. and 20 mmHg, the value of 3 msec will be stored, that is to say the difference between the absolute injection time of 15 msec and injection time $t_s = 12$ msec.

Thus, the advantage is gained that possible errors in the sensors or processing would negligibly affect the absolute injection time and accordingly the value of air-gasoline ratio, since the error has repercussions only on the difference of the injection time required for providing the stoichiometrical ratio and the time required for providing the desired ratio, which difference is generally of limited extension.

Where the carburettor shown in FIG. 5 is used as an adjusting device, the operating diagrams for the apparatus are those as shown in FIGS. 6*a–e*. It should be noted that as the engine r.p.m. and vacuum in the induction manifold vary (FIGS. 6*a* and 6*b*), the adjusting screw 6 takes various positions defining the metering amounts (FIG. 6*c*) depending on the programmed feed law, so that at each position of said screw 6 there would correspond the desired air-gasoline ratio.

Figure 6:
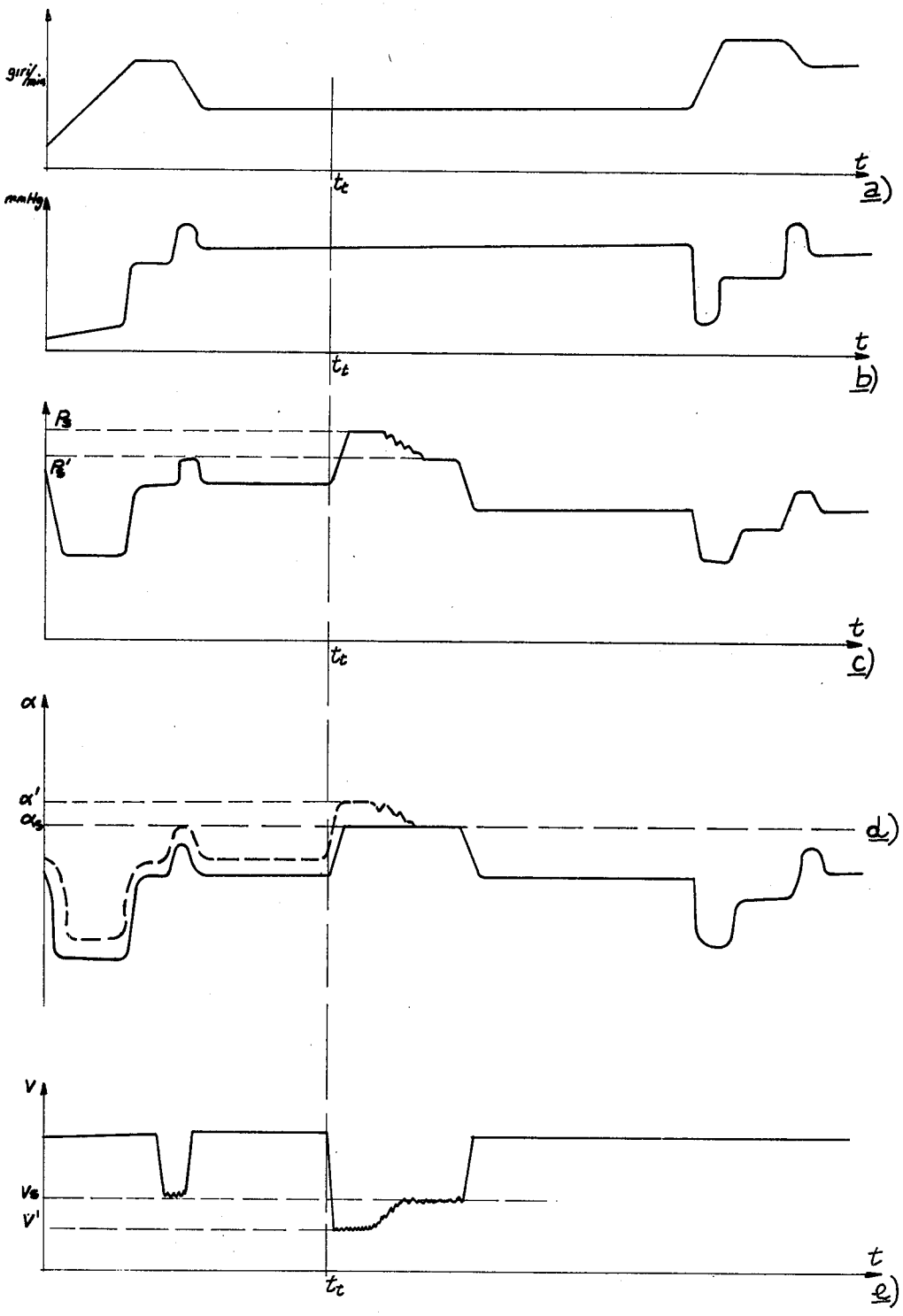
FIGS. 6*a–e* show operation diagrams of the apparatus of FIG. 1, in the case that the governor or metering device for the mixture strength is that shown in FIG. 5.

The value of such air-gasoline ratio is the desired value (see continuous line in FIG. 6*d*) if the carburettor is calibrated, while should the carburettor be out of calibration and supply less amounts of gasoline, the value of air-gasoline ratio would be greater than the desired value (see dashed line in FIG. 6*d*). Assuming the case of the latter condition, and that the carburettor calibration is started at instant $t_t$, then the apparatus operation is as follows.

The microcomputer controls the stepping motor 7 to move said screw 6 to position $p_s$ (FIG. 6*c*). With this screw 6 at such a position, the engine should be supplied with a stoichiometrical air-gasoline mixture, but due to out of calibration condition such a mixture will have an air-gasoline ratio $\alpha'$ different from $\alpha_s$ (FIG. 6*d*). The microcomputer detects the signal V' supplied by exhaust gas sensor $S_1$ (FIG. 6*e*) and controls said stepping motor 7 until the signal supplied by sensor $S_1$ takes the value $V_s$. Such a condition occurs with said screw 6 at position $p_s'$. Having found this position $p_s'$ enabling to feed the engine with a mixture having stoichiometrical air-gas ratio, said microcomputer controls said stepping motor to position said screw 6 to feed the engine with a mixture having the strength as set by the feed law.

The various positions taken by screw 6 after the calibration step are all corrected by the difference between positions $p_s$ and $p_s'$. The calibration request for said adjusting device may be automatic or manual. In case of automatic control, the microcomputer is provided with means for detecting the occurrence of calibration request conditions. For example, such means could be a clock capable of supplying a calibration start control signal after a predetermined operation time, or an odometer capable of supplying such a signal after a predetermined amount of kilometers run.

In any case, such control signals initiate the calibration operation only in case of certain engine operating conditions. Such operating conditions are checked by the microcomputer program.

As used herein, the term "univocal signal" refers to a signal which has one meaning only; that is, a signal which has a one to one relationship to the value it represents. For example, sensor $S_1$ generates univocal values of its output signal (V in FIG. 4) only for values of the air/gasoline ratio which fall within the range $\alpha_s-\Delta\alpha$ and $\alpha_s+\Delta\alpha$ about stoichiometric value $\alpha_s$. Outside of this range, the output signal V is ambiguous since it can represent a large number of values of the air/gasoline ratio (e.g., when V=1 volt it can represent any value of the air/gasoline ratio between 0 and $\alpha_s-\Delta\alpha$).

What is claimed is:

1. An apparatus for controlling the air/gasoline ratio of an air-gasoline mixture supplied to a combustion chamber of an internal combustion engine, comprising:

metering means for adjusting the air/gasoline ratio of an air-gasoline mixture supplied to a combustion chamber of an internal combustion engine responsive to a control signal applied thereto;

exhaust gas sensor means for generating a first signal representative of the actual air/gasoline ratio of said air-gasoline mixture, said exhaust gas sensor means being capable of generating univocal values of said first signal only for air/gasoline ratios which fall within a predetermined range about the stoichiometric value of said air/gasoline ratio;

characteristic parameter sensing means for generating second signals representative of the value of characteristic operating parameters of said engine;

storage means for storing a plurality of first values of said control signal, each of said first values of said control signal corresponding to a different combination of said characteristic operating parameters and being predetermined to cause said metering means to adjust said air/gasoline ratio in such a manner that said engine operates in a desired manner for that combination of characteristic operating parameters with which it corresponds, said stored first values of said control signal including values which will cause said metering means to adjust the value of said air/gasoline ratio to values which fall outside of said predetermined range of air/gasoline ratios;

control means for applying said control signal to said metering means, the value of said control signal corresponding to that one of said stored first values which corresponds to said combination of characteristic parameters which is sensed by said characteristic parameter sensing means; and calibration means for periodically updating the values of said first stored values by comparing the actual value of said control signal which must be applied to said metering means to cause said metering means to adjust said air/gasoline ratio to said stoichiometric value with a second stored value of said control signal which has been predetermined to cause said metering means to adjust said air/gasoline ratio to reach said stoichiometric value for that combination of characteristic parameters which is sensed by said characteristic parameter sensor means.

2. An apparatus according to claim 1, wherein said calibration means:

applies said second stored value of said control signal which has been predetermined to cause said metering means to adjust said air/gasoline ratio to said stoichiometric value to said metering means;

adjusts the value of said control signal until said control signal causes said air/gasoline ratio to reach said stoichiometric value;

stores the difference between said second stored value of said control signal which has been predetermined to cause said metering means to adjust said air/gasoline ratio to said stoichiometric value and said adjusted value of said control signal; and updates each of said stored first values of said control signal by an amount corresponding to said second stored value.

3. An apparatus according to claim 1 or 2, wherein said calibration means includes means for automatically initiating said updating operation.

4. An apparatus according to claim 3, wherein said calibration means initiates said updating operation at predetermined time intervals.

5. An apparatus according to claim 3, wherein said calibration means initiates said updating operation whenever a vehicle which is powered by said engine travels a predetermined distance as determined by an odometer.

6. An apparatus according to claim 3, wherein said updating operation may be initiated by an operator of a vehicle powered by said engine.

7. An apparatus according to claim 3, wherein said calibration means will not perform said updating operation whenever said characteristic operating parameters fall outside of a predetermined range.

8. An apparatus according to claim 3, wherein said calibration means terminates said updating operation whenever at least one of said characteristic operating parameters undergoes a change which is greater than a predetermined magnitude.

9. An apparatus according to claim 1, wherein said metering means is a gas injector which controls said air/gasoline ratio by controlling the amount of time said gas injector injects gasoline into said air-gasoline mixture and wherein said control signal varies the amount of time said gas injector gasoline into said air-gasoline mixture by controlling the amount of time said control signal is applied to said gas injector.

10. An apparatus according to claim 9, wherein each of said stored first values corresponds to the amount of time said control signal is to be applied to said injector for its associated combination of characteristic operating parameters.

11. An apparatus according to claim 1, wherein said metering means comprises a carburetor which controls the value of said air/gasoline ratio as a function of the position of a choke screw located in the feed duct of said carburetor and a stepping motor which controls the position of said screw in said feed duct as a function of said control signal.

12. An apparatus according to claim 1, wherein said metering means comprises a valve located in an air duct supplying air to said air-gasoline mixture and means for adjusting the position of said valve as a function of said control signal.

13. An apparatus according to claim 1, further including means for generating third signals representative of environmental conditions surrounding said engine and wherein said control means controls the operation of said metering means as a further function of said third signals.

* * * * *